United States Patent [19]

Benton

[11] Patent Number: 4,799,373

[45] Date of Patent: Jan. 24, 1989

[54] BENDING MACHINE

[76] Inventor: Ronald E. Benton, "Mount Royal", Liphook Road, Headley, Hampshire, GU35 8LL, England

[21] Appl. No.: 8,129

[22] Filed: Jan. 23, 1987

[30] Foreign Application Priority Data

Jan. 29, 1986 [GB] United Kingdom ..... 8602147
Nov. 3, 1986 [GB] United Kingdom ..... 8626229

[51] Int. Cl.[4] ..... B21D 7/022

[52] U.S. Cl. ..... 72/307; 72/216; 72/219; 72/306

[58] Field of Search ..... 72/306, 307, 294, 216, 72/217, 218, 219, 135, 137

[56] References Cited

U.S. PATENT DOCUMENTS

| | | | |
|---|---|---|---|
| 3,373,587 | 3/1968 | Shubin et al. | 72/216 |
| 3,493,016 | 2/1970 | Ott | 72/307 |
| 3,728,885 | 4/1973 | Ames | 72/294 |
| 4,000,636 | 1/1977 | Shubin et al. | 72/173 |
| 4,367,641 | 1/1983 | Mitzutani | 72/307 |
| 4,555,924 | 12/1985 | Remy et al. | 72/307 |
| 4,571,974 | 2/1986 | Pollhammer et al. | 72/219 |
| 4,665,731 | 5/1987 | Yagi et al. | 72/307 |

OTHER PUBLICATIONS

"Pneuform" Model PB600 Programmable Wire Bending Machine (Pneuform Bending Machines, Ltd. Surrey, England).

*Primary Examiner*—David Jones
*Attorney, Agent, or Firm*—Berman, Aisenberg & Platt

[57] ABSTRACT

A bending machine for bending wire, tubing, or other elongate material, comprising a support structure and a bending head which is mounted on the support structure and which is capable of bending such material in a given plane which is fixed relative to the bending head. A feed unit is mounted on the support structure and is arranged to feed such material along a feed axis of the machine to the bending head. The bending head is rotatable about the said feed axis of the machine thereby to enable the machine to bend the material into more than one plane. Furthermore, substantially the whole of the bending head is positioned to one side of the said feed axis of the machine.

15 Claims, 4 Drawing Sheets

BENDING MACHINE

The present invention relates to a bending machine for bending wire, tubing, or other elongate material.

Hitherto, such a machine for bending elongate material into a three-dimensional shape has been provided with means for rotating the material relative to a bending head of the machine to enable the material to be bent into more than one plane.

A disadvantage of this is that the length of the elongate material which is fed into the machine cannot excede a predetermined relatively short length. For example, wire can not be fed into the machine from a coil or rolled stock. If the limit is exceded, rotation of the material at or near the bending head, when the bending plane is changed, may result in a permanent twist or bend in the material which is about to be fed into the machine.

The present invention seeks to provide a remedy.

Accordingly, the present invention is directed to a bending machine for bending wire, tubing, or other elongate material, comprising a support structure, a bending head which is mounted on the support structure and which is capable of bending such material in a given plane which is fixed relative to the bending head, and feed means mounted on the support structure and arranged to feed such material along a feed axis of the machine to the bending head, in which the bending head is rotatable about the said feed axis of the machine, thereby to enable the machine to bend the material into more than one plane, and in which substantially the whole of the bending head is to one side of the said feed axis of the machine.

An advantage of such a machine is that it can produce articles made of wire or other elongate material in which the wire has been bent into a three-dimensional shape, directly from a coil or rolled stock, which shape returns on itself to form a loop, with a complex shape such as is found for example in present day mattress or bedding springs.

Preferably, the bending head has at least one fixed projection extending outwardly from the bending head transversely of the feed axis, and a movable bending projection extending outwardly from the bending head transversely of the feed axis, the movable bending projection being cantilevered from the bending head.

Advantageously, the movable bending projection is retractable into the bending head, so that it can be passed underneath the elongate material to effect a change in the sense of bending by the bending head. Preferably, the bending proejection is a roller.

Still greater variety in the possible shapes into which the elongate material can be bent can be achieved by mounting the bending head on the end of a support arm, which extends from a rotatable bearing part of the support structure to the bending head and which is rotatable, by rotation of the bearing part, with the bending head, about the said feed axis, and which is also with the bending head positioned to one side of the said feed axis.

An example of a machine made in accordance with the present invention is illustrated in the accompanying drawings in which.

Figure 1:
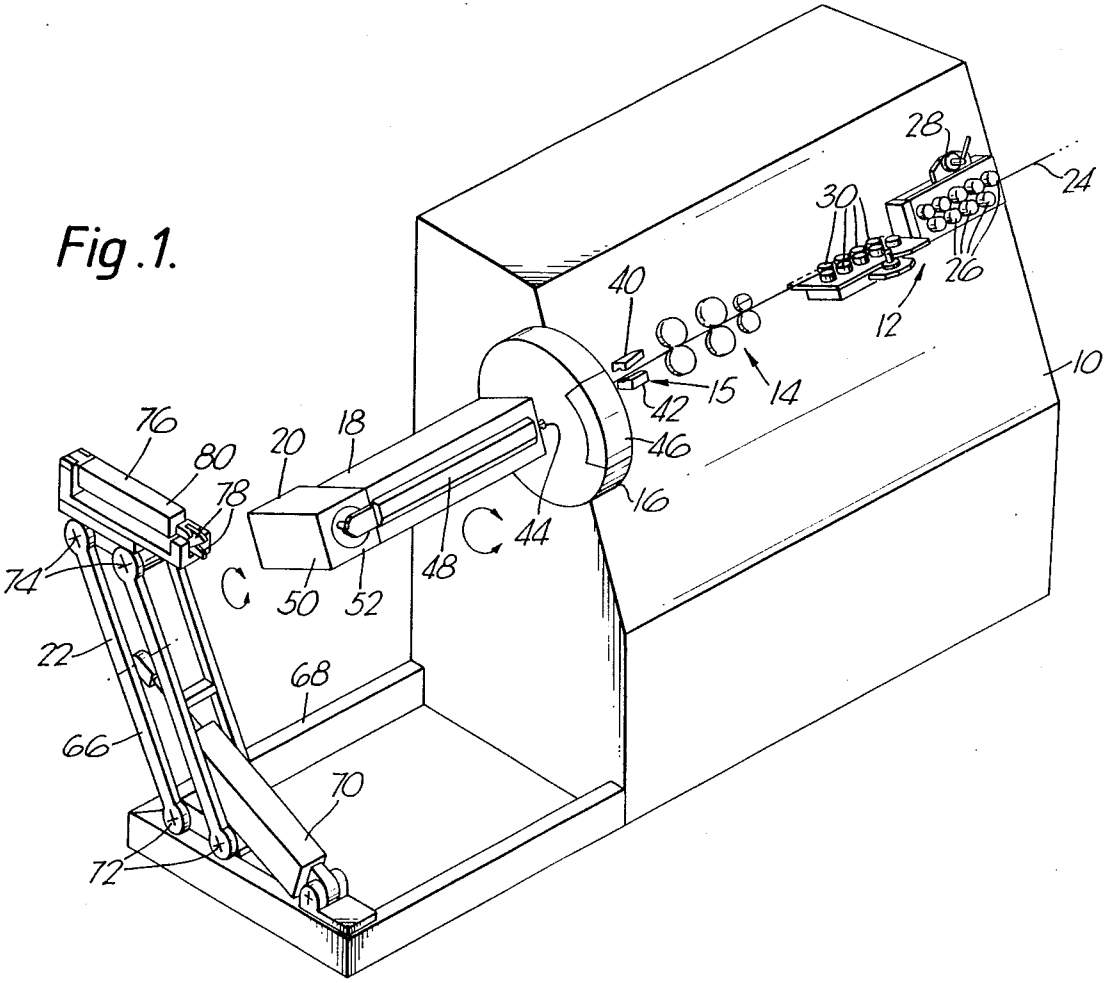
FIG. 1 is a perspective view of the machine from above and to one side thereof.
Figure 2:
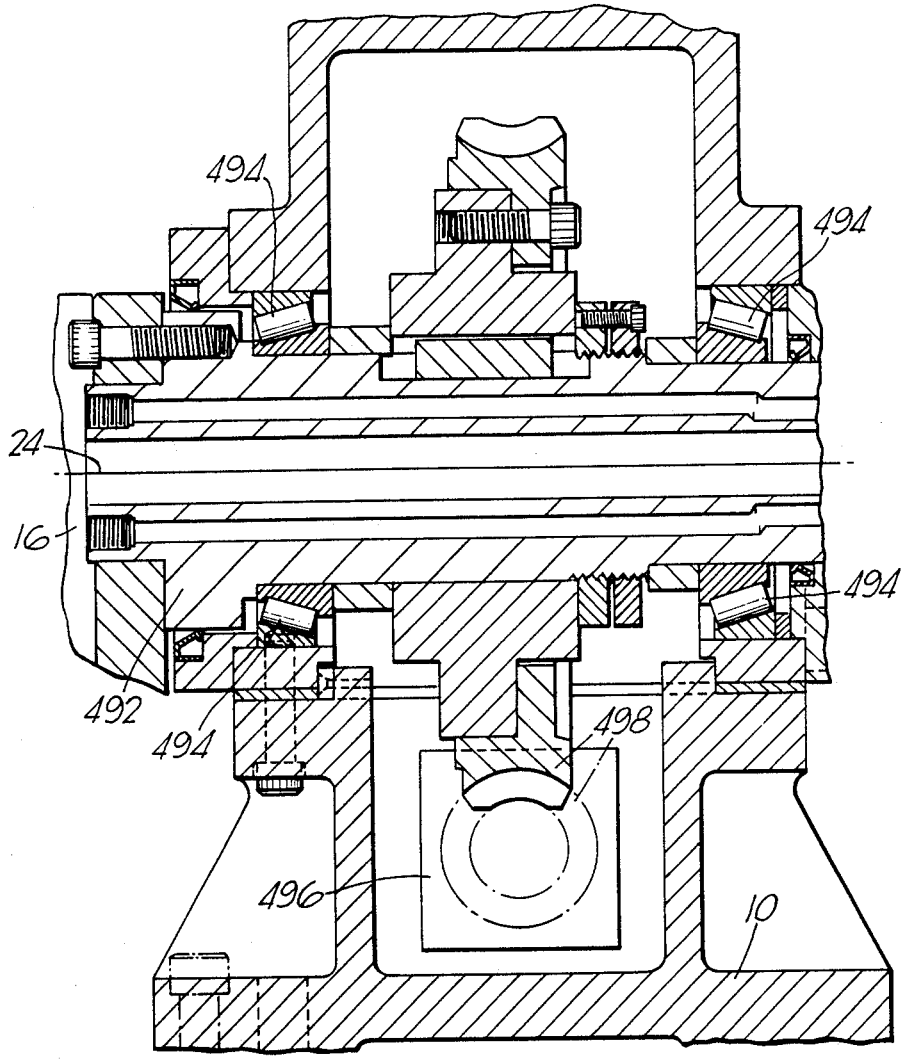
FIG. 2 is an axial sectional view of drive means of the machine by which the whole bending head is rotated about a feed axis of the machine.
Figure 3:
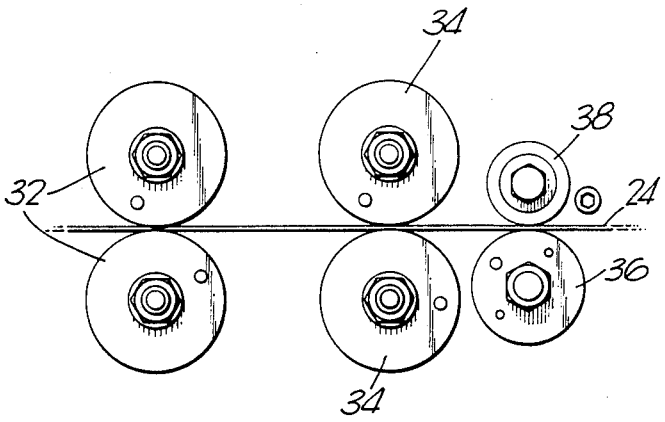
FIG. 3 is a side view of a feed unit of the machine.

FIG. 1 shows a support structure 10 on which is mounted, in spacial sequence from right to left in that Figure, a straightener 12, a feed unit 14, a clamp 15, a bending head mounting wheel 16, a bending head support arm 18, a bending head 20, and a crop unit 22. In FIGS. 1 to 3, these units are all dimensioned and constructed for bending a wire 24. However, the units may be adjusted or replaced by parts which are suitable for bending other dimensions and forms of elongate material, such as tubing.

The straightener 12 comprises a first set of nine rollers 26 arranged in a first line of five rollers on one side of a feed axis of the machine on which the wire 24 lies, and a second line of four rollers on the other side of this axis. Adjuster means 28 are provided to enable the separation of the two lines of rollers to be adjusted so that all the rollers engage the wire 24. A second set of nine rollers 30 is also provided adjacent to the first set, also extending along the axis of the machine but having the plane in which the rollers lie at right angles to the plane in which the first set of rollers 26 lies.

The feed unit 14, which also lies on the axis of the machine, is shown in greater detail in FIG. 3. It comprises two pairs of feed rollers 32 and 34, which are spaced apart along the machine axis so that a wire passes between, and is moved along the axis by, both pairs of feed rollers. A metering wheel 36 is also provided upstream of the feed rollers and is positioned so as to be in contact with and be driven by the wire 24. A pressure wheel 38 of the feed unit is positioned on the other side of the machine axis and adjacent to the metering wheel 36 to urge the wire 24 against the wheel 36, and inhibit slipping therebetween.

The clamp 15 comprises two blocks 40 and 42 disposed adjacent to and on opposite sides of the machine axis. The two blocks are moveable towards and away from one another to clamp and release the wire 24 respectively.

The wheel 16 is mounted for rotation about the machine axis up to 360 degrees in both senses of rotation. It is formed with a hole 44 through its centre to allow the wire 24 or other elongate material to pass through it. The arm 18 is mounted on this wheel so that it extends along and adjacent to the machine axis. A counterbalancing weight 46 may be provided on the wheel 16 on the opposite side thereof to the arm 18. The arm 18 is provided on that side thereof which faces the machine axis, with a straight guide 48 through which the wire 24 passes, to keep that section of the wire 24 which is immediately upstream of the bending head, straight and true.

The manner in which the wheel 16 is rotatable is indicated in FIG. 2. The wheel 16 is mounted on a fixed hollow support shaft 492 through which the wire 24 or other elongate material can pass. The shaft 492 in turn is supported in the support structure 10 via bearings 494 which allow the shaft 492 to rotate about its axis. A rotary drive of the shaft 492 is obtained from the motor 496 connected to the shaft 492 via a worm gear 498.

The bending head 20 comprises a mounting block 50 at the end of the support arm 18 which is furtherest from the wheel 16. The block 50 has a face 52 which lies in the same plane as that of the face of the arm 18 on which the straight guide 48 is mounted. Bending components mounted on that face 52 are shown in greater detail in FIG. 4. They comprise an extension 54 of the straight guide 48 so that the wire exits the guide at an end 56 of the extension 54. This end is close to the centre of the bending rotor 58. Two fixed pins or rollers 60 and 62 are positioned adjacent to the axis of the rotor 58, project outwardly from the bending head 20, and are fixed relative to the guide extension 54. They are positioned on opposite sides of the wire 24 where it leaves the guide extension 54. A bending roller 64 projects outwardly from the rotor 58, so that it is cantilevered therefrom, and is mounted thereon so that the roller axis can be selectively positioned, by rotation of the rotor 58, on any point which lies on a near complete circle centred on the axis of the rotor 58.

Thus it can be seen that, apart from a small portion of the straight guides 48 and 54, both the bending head 20 and the support arm 18 lie wholly to one side of the machine axis, and remain to one side of that axis as they are rotated about it. This enables complex formations that each complete a loop to be produced by the machine without the head 20 or arm 18 obstructing such production. The extension arm 18 increases the maximum possible size of such looped formations.

The crop unit 22 comprises a parallelogram linkage 66 mounted on a frame 68 which is part of the support structure 10. The linkage 66 is moveable by means of a hydraulic piston and cylinder arrangement 70 to rock the linkage to and fro about its lower fixed end 72. On the top of the linkage 74 there is mounted a cutter 76 the blades 78 of which are close to the machine axis, and can be moved into a position in which they are on opposite sides of the axis, to cut the wire 24, by means of the piston and cylinder arrangement 70 acting on the parallelogram linkage 66. The cutter 76 is provided with a power drive 80 to force the blades 78 together to effect cutting of the wire 74.

All the power drives for the machine, including those for the feed unit 14, the clamp 15, the mounting wheel 16, the bending head 20, the cutter 76, and the hydraulic piston and cylinder arrangement 70 operate automatically, under the command of electrical signals issued by a programmable computer.

Operation of the machine is as follows: a wire 24 is threaded through the straightener 12, the feed unit 14, the clamp 15, the wheel 16, the guide 48 and the extension guide 54. Once the end of the wire 24 has reached the feed unit 14, the latter may assist in this operation. With the wire 24 so threaded, the machine may be put into automatic action in accordance with a program which has been keyed into the computer. A wire 24 is fed through the machine by means of the feed rollers 32 and 34, and the distances by which the wire is so fed is simultaneously measured by the metering roller 36. If the wire is stopped during the bending operation, by stopping the feed rollers 32 and 34, the clamp 15 is automatically operated to ensure that the wire cannot be shifted axially or twisted during a bending operation. To provide a straight section of wire in the finished article, the wire is simply fed through the machine by the feed rollers 32 and 34 for the required distance measured by the metering roller 36. To bend the wire through a given angle in the plane of the face 52 of the bending head 20, the feed rollers 32 and 34 are stopped, the clamp 15 closes on to the wire 34, and the wire at the bending head 20 is bent by the bending roller 64 as it is rotated by the roller 58 through the required angle in relation to the fixed rollers 60 and 62.

Figure 4:
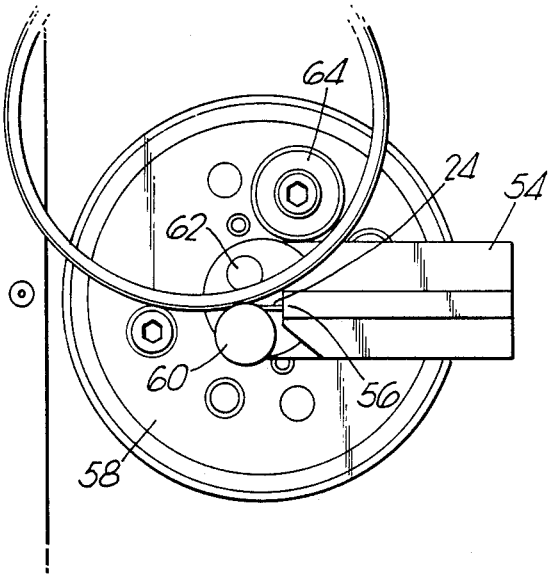
FIG. 4 is a side view of the parts of a bending head of the machine.

If the wire is to be bent upwards as viewed in FIG. 4, the roller 64 is retracted into the rotor 58 which can now be rotated in a clockwise sense until the roller 64 passes completely underneath the guide extension 54, whereafter the roller 64 is released to its projecting position and rotation of the rotor 58 is continued until the roller 64 is brought into contact with the wire 24. Rotation of the rotor 58 beyond this position now bends the wire around the upper fixed roller 62 through the required angle as determined by the computer programme. The wire 24 may be bent in the other direction in the plane 52 by the reverse action in which the wire is bent around the lower of the fixed rollers 60. Alternatively, this reverse action can be effected by rotation of the whole bending wheel, arm and head assembly through 180 degrees. This avoids the need to retract the roller 64. A steady curve in the wire can be obtained by positioning the bending roller 64 at the required position in relation to the fixed rollers 60 and 62, and, with the bending rollers so positioned, feeding the wire 24 in the forward direction in the machine by means of the feed rollers 32 and 34.

Spiral, helical, or combined spiral and helical formations and possible by simultaneously moving the bending roller 64 and/or rotating the bending head 20 as the wire 24 or other elongate material is fed in the forward direction in the machine. It is even possible to form wire into a spiral helix which has a conical shape with varying pitch, and with curved sides. This can be effected by appropriate computer programming, with appropriate changes in the rates at which the bending roller is moved and the bending head is rotated.

It will be appreciated therefore that helices, which have hitherto been made by projecting the bending roller slightly out of line from the feed axis, are now made by keeping the bending surface of the bending roller in line with the feed axis as wire is fed forwardly through the machine, rotating the head to effect the formation of a helix.

The wire may be bent in any other plane by being held against twisting by the clamp 15, and by rotation of the mounting wheel 16. This changes the plane of the face 52 without moving the wire. The wheel 16 is rotatable in this way through 360 degrees from its starting position in a clockwise sense and also through 360 degrees from that starting position in an anticlockwise sense. This enables any given rotational position of the bending head 20 to be reached by rotation of the wheel 16 in either one of the two senses. As a result, a particular setting of the bending head may be accessed by rotation of the wheel 16 in one sense which may be inaccessible by rotation in the other sense owing to obstruction by a particular configuration of wire that has already been bent.

When the various bending operations have been completed for a given article of wire, the latter is fed through the machine until the desired end of the article is positioned immediately adjacent to the crop unit 22. The piston and cylinder arrangement 70 is then operated by the computer to move the parallelogram linkage 66 and so to bring the blades 78 to opposite sides of the wire 24 at that desired end. The cutter 76 then cuts the wire at that point to free the finished article from the rest of the wire 24. If necessary, the wire 24 is then reverse-fed to bring the cut end back to the centre of the bending rotor 58.

Because the bending head, rather than the wire, is rotated relative to the machine, the wire does not have to be rotated to be bent into a three-dimensional shape. An advantage is thereby obtained that the wire 24 may be fed directly from a large coil of the material.

Numerous variations and modifications to the machine will readily occur to the reader without taking it outside the scope of the present invention. For example, instead of the roller straightener 12, a spinner straightening unit can be employed comprising two sets of rollers arranged in a generally similar manner to those of the straightener 12, but in which the rollers are continuously spun with an angular velocity which is dependent upon the feed rate and deflection between the spinner rollers or dies. Adjacent spinners rotate in opposite directions throughout operation of the machine. This avoids twisting and spiralling of the wire under the action of the spinners, and also avoids the spinners burning through the wire when the latter is held stationary, for bending operations. In addition, during bending operations, the spinners reciprocate along the machine axis.

Figure 5:
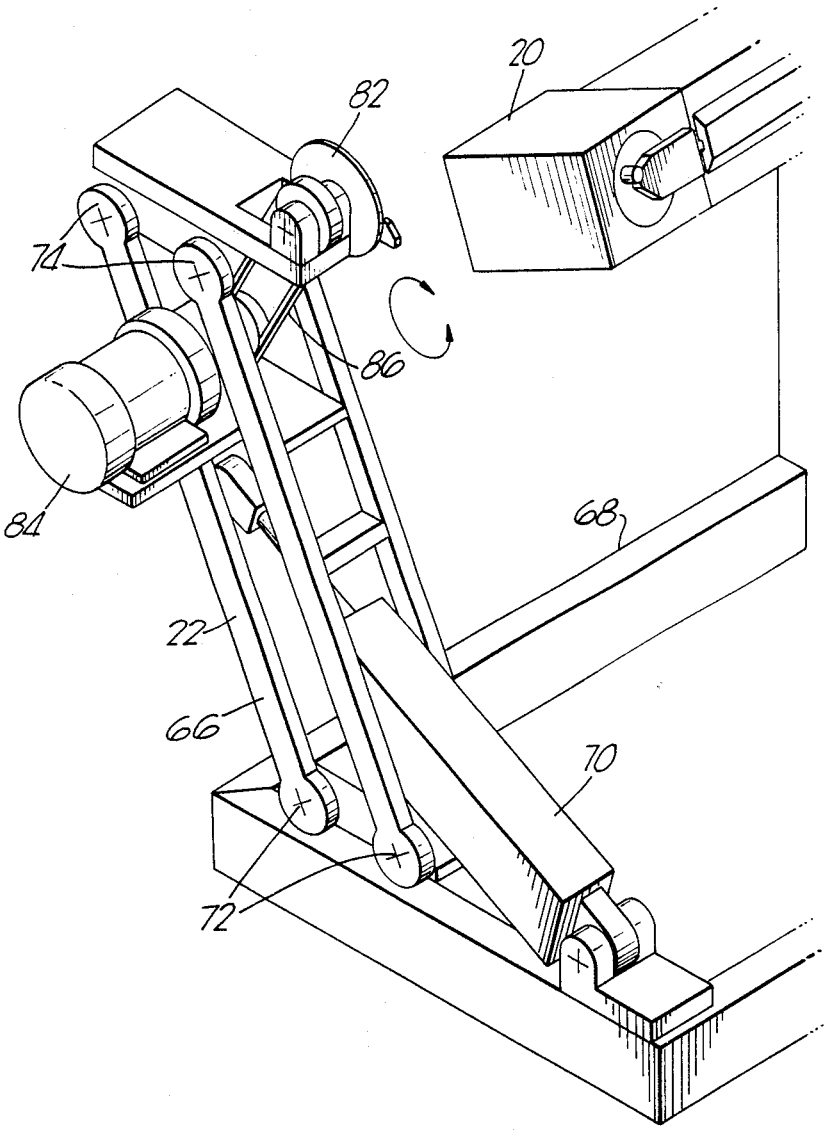
FIG. 5 is a perspective view from above and to one side of a modified form of cutting unit of the machine.

Instead of the crop unit illustrated in FIG. 1, a modified form may be used as illustrated in FIG. 5, in which the cutter 36 is replaced by a circular saw 82, driven by a motor 84 via a belt drive 86. Such a saw unit is particularly suitable for cutting through tubing.

It will be appreciated that the straightener 12 can be adjusted, and the components 14, 15, 16, 18 and 20 can be replaced to allow for wire or tubing of different diameters. The material and the wire or tubing may comprise steel, copper, or aluminium, for example.

The machine may be provided with other electronic, hydraulic or pneumatic means, in place of a computer, to retain information as to the shape and dimensions of the required finished article.

Simultaneous rotation of the bending head as the machine is in a curve making mode of operation, as described herein, may be used to make a helix.

The straightener 12 may comprise two sets of rollers each having a number of rollers other than nine, preferably an odd number.

Two pairs of feed rollers have been illustrated, but one pair could do the job, or indeed more than two pairs.

The metering wheel 36 could be positioned downstream of the feed rollers instead of upstream thereof.

I claim:

1. A bending machine for bending wire, tubing, or other elongate material, comprising a support structure, feed means mounted on the support structure and arranged to feed such material along a feed axis of the machine, a support member supported by, and extending from, the support structure and rotatable about the feed axis, the member being substantially wholly to one side of the feed axis, a bending head supported by the support member and being rotatable therewith, the bending head being substantially wholly to one side of the feed axis and comprising a bending member cantilevered from the bending head and a reaction member cantilevered from the bending head and about which the material is bent by the bending member in a plane which plane contains the feed axis and which plane is fixed relative to the bending head and the support member, rotation of the support member allowing bending of the material in any selected plane containing the feed axis.

2. A bending machine according to claim 1, in which the reaction member is a fixed projection extending outwardly from the bending head transversely of the feed axis, and the bending member is a moveable bending projection extending outwardly from the bending head transversely of the feed axis, the moveable bending projection being cantilevered from the bending head.

3. A bending machine according to claim 2, in which the movable bending projection is retractable into the bending head, so that it can be passed underneath the elongate material to effect a change in the sense of bending by the bending head.

4. A bending machine according to claim 2, in which the bending projection is a roller.

5. A machine according to claim 3 wherein the bending head has two fixed projections extending outwardly from the head transversely of the feed axis, and fixed relative to the support member one on each side of the feed axis.

6. A machine according to claim 1, wherein the reaction member is fixed relative to the support member.

7. A machine according to claim 1, comprising guide means, additional to the support member and reaction member, for guiding the fed material along the feed axis to the bending head.

8. A machine according to claim 7, wherein the guide means is supported by the support member for rotation therewith.

9. A bending machine according to claim 1, in which the support member is a support arm and the bending head is mounted on the end of the support arm, which extends from a rotatable bearing part on the support structure to the bending head and which is rotatable, by rotation of the bearing part, with the bending head, about the said feed axis.

10. A bending machine according to claim 9, in which the bearing part comprises a wheel with a central hole through which the elongate material passes when the machine is in use.

11. A bending machine according to claim 9, in which a clamp is provided on the support structure adjacent to the bearing part to clamp the elongate material at a position immediately upstream of the bearing part when the bearing part rotates, and so prevent the elongate material rotating therewith.

12. A bending machine according to claim 1, in which the bending head is rotatable about the said feed axis of the machine through at least 180 degrees, so that the elongate material can be bent in one sense, and also in the opposite sense by the same action of the bending head following rotation thereof through 180 degrees.

13. A bending machine according to claim 12, in which the bending head is rotatable about the said feed axis of the machine through at least 360 degrees, so that it can reach a second position from a first position by rotation in either selected one of two senses, so that if rotation in one sense is obstructed, rotation in the opposite sense may still be possible.

14. A bending machine according to claim 13, in which the bending head is rotatable about the said feed axis of the machine through at least 720 degrees.

15. A bending machine for bending wire, tubing, or other elongate material, comprising (a) a support structure, (b) a bending head which is capable of bending such material in a given plane which is fixed relative to the bending head, (c) feed means mounted on the support structure and arranged to feed such material along a feed axis of the machine to the bending head, (d) a support arm, on the end of which the bending head is supported, (e) a rotatable bearing part on the support structure, the arm extending to the bending head from the bearing part and being rotatable, by rotation of the bearing part, with the bending head, about the said feed axis, and being, with the bending head, positioned substantially wholly to one side of the said feed axis, whereby the bending head is rotatable about the said feed axis of the machine, thereby to enable the machine to bend the material into more than one plane, and wherein the bearing part is provided with a counterbalance to counterbalance the weight of the support arm and the bending head.

* * * * *